US005706981A

United States Patent [19]

Nobakht

[11] Patent Number: 5,706,981

[45] Date of Patent: Jan. 13, 1998

[54] DISPENSING CLOSURE FOR CONTAINER

[76] Inventor: Jamshid Nobakht, 6800 MacDonald Avenue, #110, Cote St. Luc, Quebec, Canada, H3X 3Z2

[21] Appl. No.: 561,497

[22] Filed: Nov. 20, 1995

[30] Foreign Application Priority Data

Nov. 26, 1994 [GB] United Kingdom ..... 9423934

[51] Int. Cl.[6] ..... B67D 5/60

[52] U.S. Cl. ..... 222/132; 222/142.7; 222/480; 222/556; 220/335

[58] Field of Search ..... 222/132, 142.1, 222/142.7, 142.9, 153.14, 480, 481, 556, 565; 220/524, 254, 335

[56] References Cited

U.S. PATENT DOCUMENTS

| | | | |
|---|---|---|---|
| 1,279,235 | 9/1918 | Bontya | 222/142.1 |
| 4,488,667 | 12/1984 | Swett et al. | 222/142.7 |
| 4,881,668 | 11/1989 | Kitterman et al. | 222/556 |
| 5,219,100 | 6/1993 | Beck et al. | 220/335 |
| 5,503,289 | 4/1996 | Fox | 220/335 |

*Primary Examiner*—Philippe Derakshani
*Attorney, Agent, or Firm*—Eric Fincham

[57] ABSTRACT

A closure suitable for use with a condiment container which has a dispensing mouth formed therein, the closure comprising a cover adapted to fit over the mouth of the container and having a plurality of dispensing sections formed therein with at least one dispensing aperture in each dispensing section, each dispensing section having a sealing flap associated therewith, the sealing flap being hingedly secured whereby the flap can be moved from a first position in an overlying sealing relationship with the dispensing aperture to a second open position permitting access to the dispensing aperture. The closure has a pair of retaining posts for retaining the flap in the open position. Since there are a plurality of dispensing sections, the closure can function as a universal closure for many different types of condiments.

5 Claims, 2 Drawing Sheets

DISPENSING CLOSURE FOR CONTAINER

BACKGROUND OF THE INVENTION

The present invention relates to a closure and more particularly, relates to a closure suitable for use with containers for condiments such as spices or the like.

The use of containers for dispensing condiments such as spices and the like is well known in the art. A frequently used utilized commercial embodiment is the use of shake and spoon containers. The containers themselves are generally of a cylindrical configuration and formed of a suitable plastic, glass, fiberboard or metallic material. In the shake and spoon type of closure, the closure itself has one relatively large opening so that a spoon or other instrument can be inserted to remove the material in large volumes while a second opening is provided for dispensing the material by shaking through a plurality of smaller apertures.

It is also known in the art solely to have the one set of apertures for shaking while requirement removal of the closure for larger volumes.

Common to both of the above types of closures is that the closure must be designed for the specific type of spice or condiment. Thus, not all of the spices or condiments are suitable for the same size aperture such as when the spice is in a ground form compared to a leaf form. Naturally, it becomes inconvenient for the manufacturer to stock a plurality of closures, each having an aperture size appropriate to the particular condiment and the form thereof.

SUMMARY OF THE INVENTION

It is an object of the present invention to provide a closure for a condiment container wherein the closure is suitable for use with a plurality of different types of condiments.

It is a further object of the present invention to provide a closure of a universal nature having different size dispensing apertures available therein and which may be easily and economically manufactured.

According to one aspect of the present invention, there is provided a closure suitable for use with a condiment container which has a dispensing mouth formed therein, the closure including a cover adapted to fit over the mouth of the container. The cover portion includes a plurality of dispensing sections with each dispensing section having at least one dispensing aperture formed therein. Each dispensing section also has a sealing flap associated therewith, the sealing flap being hingedly secured such that the flap can be moved from a first position wherein the flap is in an overlying sealing relationship with the dispensing aperture to a second open position permitting access to the dispensing aperture. The closure also includes means for retaining the flap in the second open position.

In greater detail, the closure of the present invention is adapted to be used with a container wherein one has the option of shaking the container to dispense relatively small amounts of material. As such, the material within the container will normally be in a relatively fine particulate form as is frequently the case for herbs, spices and other condiments.

The container may be formed of any suitable material and can be of any desired configuration. However, it is conventional in the art that containers have a generally rectangular or cylindrical configuration and are of the type wherein the mouth of the Container is of a circular configuration to accept a screw on or snap on closure. The container can conveniently be formed of a suitable material with glass and plastic being the most widely used materials.

The closure of the present invention is preferably formed of a plastic material for economy and ease of manufacture; such materials include for example, polyethylene and polypropylene. As aforementioned, most containers have a generally circular mouth and accordingly the closure would have a like configuration although it is within the scope of the invention that other configurations could be used with suitable means for attaching the closure to the container.

The closure includes an upper cover portion having a skirt depending downwardly therefrom and which skirt will normally engage the walls of the container in a locking relationship. As aforementioned, this may be by means of a screw threaded engagement with the container walls or alternatively by a press fit.

The closure, as aforementioned, includes a cover portion which is adapted to be in an overlying relationship to the mouth of the container. The cover portion has a plurality of dispensing sections formed therein, each dispensing section preferably being designed to dispense a different size particle. Although one could form a number of different dispensing sections from two upwards, it has been found that three such sections is convenient for most requirements.

Each dispensing section has at least one dispensing aperture formed therein; in most instances, a plurality of dispensing apertures are provided. In some instances, one of the dispensing sections may only have one relatively large aperture thus permitting access thereto by an instrument such as a spoon or the like. Naturally, the various sizing of the apertures is known to those knowledgeable in the art and can be varied according to the specific requirements.

Each dispensing section having the dispensing apertures has a sealing flap member associated therewith.

The flap is hingedly connected such that it can be moved from a first position whereby it is in sealing relationship with respect to the dispensing apertures to a second position permitting access to the contents of the container. Different configurations are possible including connection of the flap directly to the cover portion by means well known to those knowledgeable in the art, or in a preferred embodiment, there is provided a separate sealing member which is suitably secured to the cover portion and which sealing member has the flaps formed as a part thereof.

The closure of the present invention also includes means for retaining the flap in its open position. To this end, there may be provided first means on one portion of the sealing member or cover which act in cooperation with second means on the flap to retain the flap in the open position. In a preferred embodiment, the first means may comprise a pair of posts or elongated members adapted to receive a post associated with the flap to frictionally retain the same. This embodiment provides the advantage of ease of molding and use.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
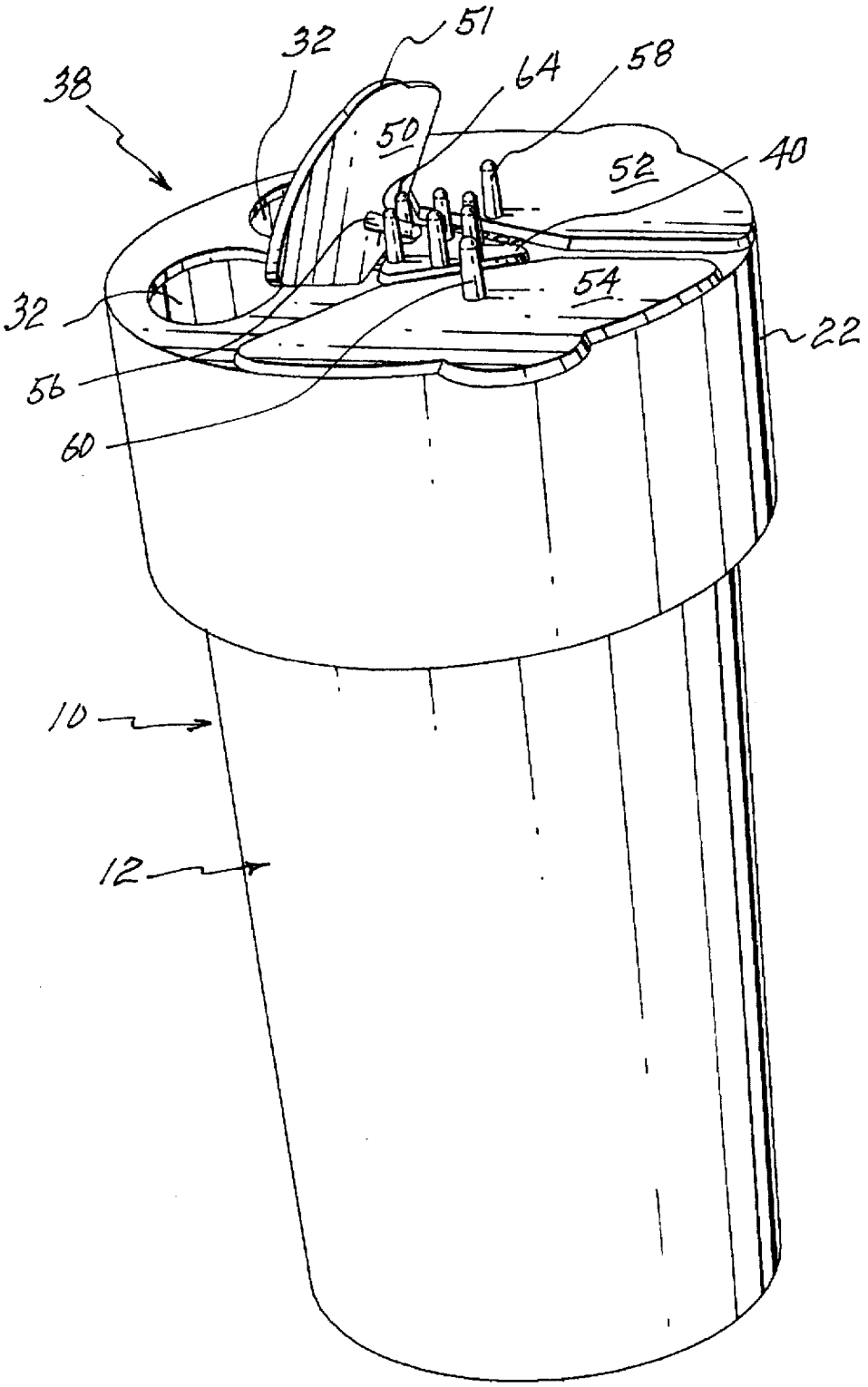
FIG. 1 is a perspective view of a container utilizing a closure according to the present invention.
Figure 2:
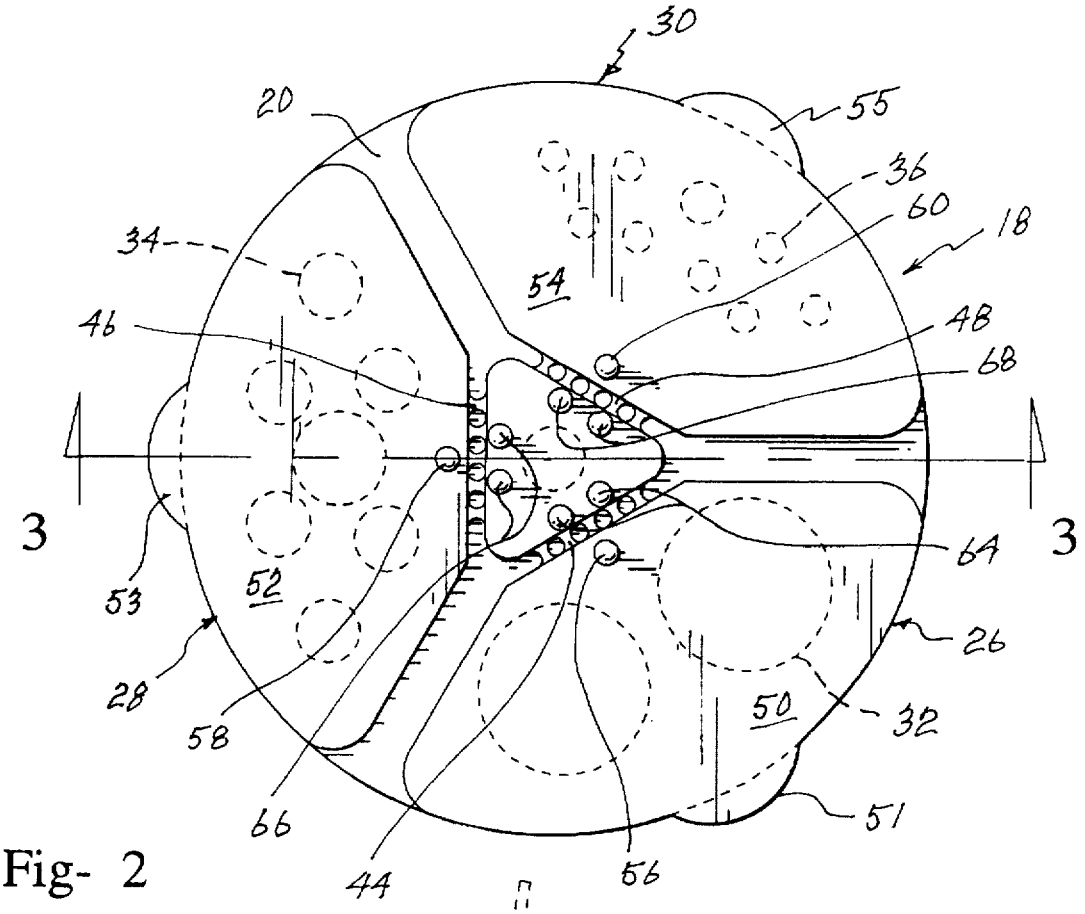
FIG. 2 is a top plan view thereof.
Figure 3:
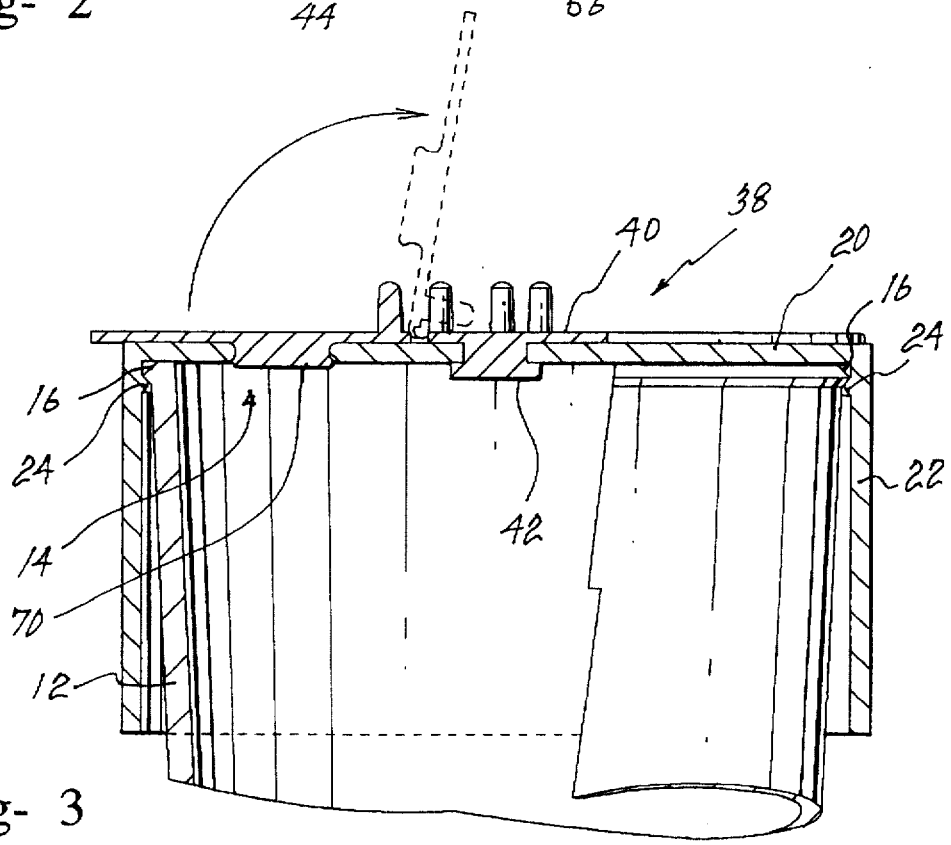
FIG. 3 is a sectional view taken along the lines 3—3 of FIG. 2.

Referring to the drawings in greater detail and by reference characters thereto, there is illustrated in FIG. 1 a container 10 having a cylindrical wall 12 defined, at one end, a mouth which is generally designated by reference numeral 14. The container is that type which is often used with containers of spices or other condiments. In the illustrated embodiment, the cylindrical 12 has, at the end adjacent mouth 14, an outwardly extending bead or rim 16.

A closure according to the present invention is generally designated by reference numeral 18 and includes a cover portion 20 having a downwardly extending skirt 22. Skirt 22 includes an inwardly extending bead 24 sized to retain closure 18 in position by engagement with rim 16. This is a conventional arrangement or alternatively, a screw type arrangement could be employed.

Cover portion 20 may generally be divided into three different dispensing sections which are generally designated by reference numerals 26, 28 and 30. Dispensing section 26 has a pair of relatively large dispensing apertures 32 while dispensing section 28 has a plurality of "medium" size dispensing apertures 34. Dispensing section 30 has a plurality of relatively small dispensing apertures 36. Dispensing aperture 32, 34 and 36 are formed in cover portion 20 and their size and number may be varied.

Associated with cover portion 20 is a sealing member 38, and which sealing member 38 has a center portion 40 having a downwardly extending lug 42 which is sized and shaped to fit within an aperture formed within cover portion 20 to thereby retain sealing member 38 in its desired location.

A first flap member 50 is connected by means of a hinge section 44 to center portion 40 of sealing member 38 and which flap member is designed to cover dispensing apertures 32. In the illustrated embodiment, flap 50 has downwardly extending elements 70 adapted to sealingly engage with dispensing apertures 32. Extending outwardly from the peripheral edge of flap 50 is a tab portion 51.

A similar arrangement is provided with respect to dispensing section 28; there is thus provided a flap member 52 having a tab portion 53 and which is connected by means of hinge section 46 to center portion 40 of sealing member 38. Likewise, dispensing section 30 includes a flap 54 and associated tab 55 connected through hinge section 48 to center portion 40.

Flap 50 also includes, as may be seen clearly in FIG. 1, an upwardly extending post or projection 56. A similar arrangement is provided with respect to flaps 52 and 54 which have upwardly extending posts or projections 58 and 60 respectively.

Mounted on center portion 40 of sealing member 38 are sets of upwardly extending posts which are adapted to function in conjunction with the posts on the flaps. Thus, a pair of posts 64 extend upwardly from center portion 40 and are sized and positioned such that when flap 50 is rotated about its hinge 44, post 56 fits between posts 64 of center section 40 and is frictionally retained therein. Thus, access to dispensing apertures 32 is provided without interference from flap 50. Sets of posts 66 and 68 are associated with flaps 52 and 54 respectively.

As may be seen from the above, the closure of the present invention is suitable for use in varying applications. Thus, the closure may be used as a "universal" closure for many different types of condiments and spices. One can select the dispensing apertures having the desired size for the particular requirement.

It will be understood that the above described embodiment is for purposes of illustration only and that changes and modifications may be made thereto without departing from the spirit and scope of the invention.

I claim:

1. A closure comprising a cover portion having a downwardly depending skirt adapted to engage a side wall of a container and with said cover portion being adapted to cover a mouth of said container, said cover member having a plurality of dispensing sections, each of said dispensing sections having at least one dispensing aperture formed therein, a sealing member having a central portion secured to said cover portion, each dispensing section having a sealing flap associated therewith, each of said sealing flaps being hingedly secured to said central portion such that said flaps can be moved from a first position wherein each of said flaps is in an overlying sealing relationship with one of said dispensing apertures to a second position permitting access to said dispensing apertures, and means for retaining said flaps in said second open position.

2. The closure of claim 1 wherein said cover portion includes three dispensing sections, at least two of said dispensing sections having a plurality of apertures formed in said cover portion.

3. The closure of claim 2 wherein each of said dispensing sections have apertures of a different size formed therein.

4. The closure of claim 1 wherein said central portion has a retaining means associated therewith, each of said flaps having a member adapted to cooperatively engage with said retaining means to retain said flap in an open position.

5. The closure of claim 4 wherein said retaining means associated with said central portion comprise a pair of spaced apart upwardly extending elements, said member on said flap being located and sized so as to fit between said spaced apart elements and to be frictionally retained thereby when said flap is in a open position.

* * * * *